US005959270A

United States Patent [19]

Wecke et al.

[11] Patent Number: 5,959,270

[45] Date of Patent: Sep. 28, 1999

[54] SAFETY SWITCH

[75] Inventors: Rolf Wecke, Bückeburg; Ralph Hoppmann, Minden; Roland Mönnings, Porta Westfalica, all of Germany

[73] Assignee: Hans Bernstein Spezialfabrik für Schaltkontakte GmbH & Co., Porta Westfalica, Germany

[21] Appl. No.: 09/247,140

[22] Filed: Feb. 9, 1999

[30] Foreign Application Priority Data

Feb. 20, 1998 [DE] Germany ..... 298 03 028 U

[51] Int. Cl.[6] ..... H01H 27/00

[52] U.S. Cl. ..... 200/43.07; 200/17 R; 200/61.62

[58] Field of Search ..... 200/17 R, 43.01, 200/43.04–43.09, 61.62–61.68, 334

[56] References Cited

U.S. PATENT DOCUMENTS

| | | | |
|---|---|---|---|
| 5,464,954 | 11/1995 | Kimura et al. | 200/61.62 |
| 5,516,993 | 5/1996 | Wecke et al. | 200/17 R |
| 5,622,253 | 4/1997 | Wecke et al. | 200/43.07 |
| 5,703,339 | 12/1997 | Rapp et al. | 200/17 R |
| 5,760,353 | 6/1998 | Rapp | 200/17 R |
| 5,777,284 | 7/1998 | Mohtasham | 200/43.04 |
| 5,868,243 | 2/1999 | Bachle | 200/334 |

*Primary Examiner*—Michael Friedhofer
*Attorney, Agent, or Firm*—Henry M. Feiereisen

[57] ABSTRACT

A safety switch includes a housing and a switching mechanism comprised of a controller drum which has opposite end faces and is rotatably mounted in the housing, and an actuator which is insertable from outside into the housing for rotating the controller drum about a predetermined angle and thereby actuating a switch plunger. Incorporated in the safety switch is a safety mechanism which includes at least one contact structure attached in fixed rotative engagement to one of the end faces of the controller drum and having an outer edge, and a plunger bearing on the outer edge of the contact structure. The plunger is loaded by at least one spring and slidably mounted in the housing for movement in opposition to the spring to apply onto the contact structure and thereby onto the controller drum a torque which in respect to a direction of rotation of the controller drum into the actuation position of the switch plunger acts either in a same direction or in an opposite direction, depending on whether the actuator should be secured against inadvertent detachment or whether the actuator should be ejected when an outside force applied on the actuator is removed.

21 Claims, 4 Drawing Sheets

SAFETY SWITCH

CROSS-REFERENCES TO RELATED APPLICATIONS

This application claims the priority of German Patent Application Serial No. 298 03 028.4, filed Feb. 20, 1998, the subject matter of which is incorporated herein by reference.

BACKGROUND OF THE INVENTION

The present invention relates, in general, to a safety switch, and more particularly to a safety switch of a type having a housing and a controller drum rotatably mounted in the housing and operated by an actuator, insertable into the housing, for rotation of the controller drum about a predetermined angular range for operating a switch plunger.

Safety switches of this type are known in many designs and are used for a wide range applications e.g. to cut the current supply to an equipment or a machine when a protective cover is removed or when equipment access doors and cabinet doors are opened. Such safety switches are typically formed with an access opening for entry of an actuator, e.g. a key, to operate the switch. Common to all safety switches of this type is that they effect a shut-off when the actuator is withdrawn. The switch housing contains the switching mechanism including the controller drum and the switch plunger which operates a switch when moving in a longitudinal direction, and other suitable, electrical as well as electronic components.

Safety switches are known which have incorporated therein magnetic clamps to retain the actuator in place after insertion in the housing and actuation of the safety switch, to thereby avoid an inadvertent detachment of the actuator form the housing, e.g. by shocks or the like. These magnetic clamps are attached only at the outer area of the access openings for the actuator, and thus remain unprotected.

SUMMARY OF THE INVENTION

It is thus an object of the present invention to provide an improved safety switch, obviating the afore-stated drawbacks.

In particular, it is an object of the present invention to provide an improved safety switch, which includes additional safety features, while yet being of simple structure and reliable in operation.

These objects, and others which will become apparent hereinafter, are attained in accordance with the present invention by providing a safety mechanism for preventing the actuator from inadvertent detachment, with the safety mechanism including at least one contact structure attached in fixed rotative engagement to one of the end faces of the controller drum and having an outer edge, and a plunger bearing on the outer edge of the contact structure, whereby the plunger is loaded by at least one spring and slidably mounted in the housing for movement in opposition to the spring to apply onto the contact structure and thereby onto the controller drum a torque which acts in a same direction as a direction of rotation of the controller drum into the actuation position of the switch plunger.

Through incorporation of such a safety mechanism, the safety switch can be complemented with purely mechanical components that are accommodated in the housing and thus protected, for realizing an enhanced or reinforced retention force on the actuator. Thus, an actuation of the safety switch by shocks, vibrations or the like can practically be eliminated.

According to another feature of the present invention, the controller drum has an effective range of angle of rotation, whereby the contact structure has a curved section in the effective range of angle of rotation, with the curved section being so designed as to have in direction of rotation of the controller drum a continuously ascending configuration until shortly before the actuation position is reached and a descending configuration after surpassing an upper dead center.

According to another embodiment of the present invention, the switching mechanism is so configured that the torque is applied onto the contact structure and thereby onto the controller drum in an opposite direction to the direction of rotation of the controller drum into the actuation position of the switch plunger. In this manner, different safety aspects are satisfied that oftentimes occur in practice. For example, situations exist in which machine tools should be so designed as to allow an operation even though the protective hood is open. However, in view of the increased risk, many workshops provide so-called "master keys" for use by especially reliable employees. Such a master key basically conforms to typically used actuators for a safety switch so that the authorized operator is able to insert by hand the master key into the access opening of a safety switch to actuate the safety switch.

In this embodiment, the curved section of the contact structure is so designed as to have, in direction of rotation of the controller drum, a continuously ascending configuration until the actuation position of the controller drum is reached.

By incorporating a safety mechanism according to the second embodiment of the present invention, the safety switch can thus be so configured that the master key is ejected from the housing as soon as the operator releases the master key as a result of carelessness, or detraction or other interference. Thus, the machine is shut down immediately to guard against potential hazards.

According to another feature of the present invention, the contact structure may be a cam plate or an eccentric plate.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
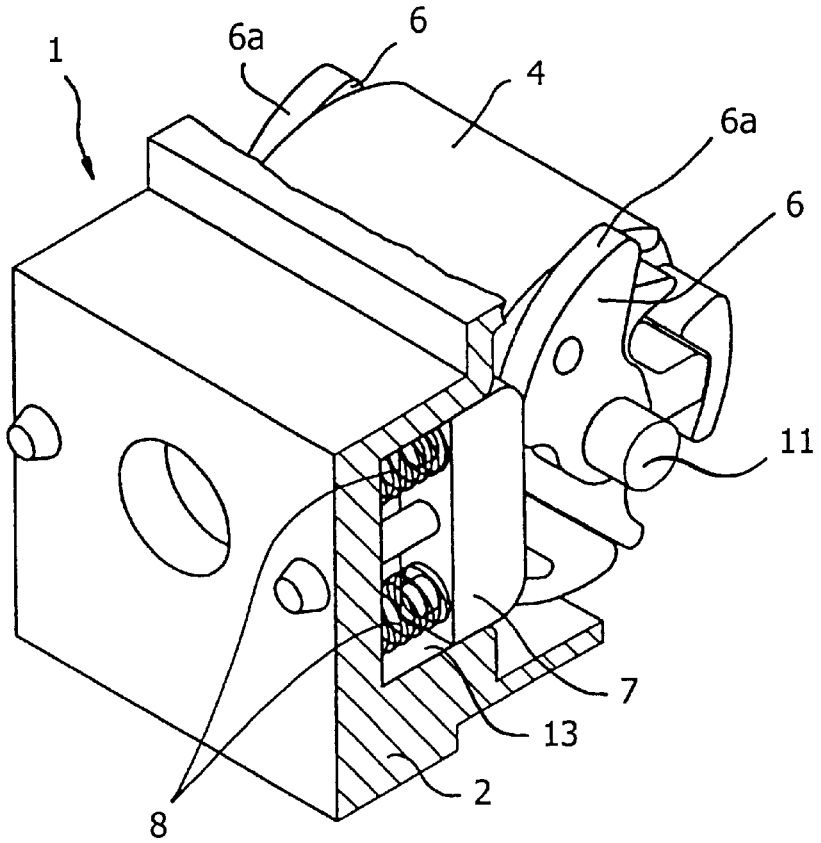
FIG. 1 is a fragmentary, perspective view of a safety switch according to the present invention in idle state.
Figure 2:
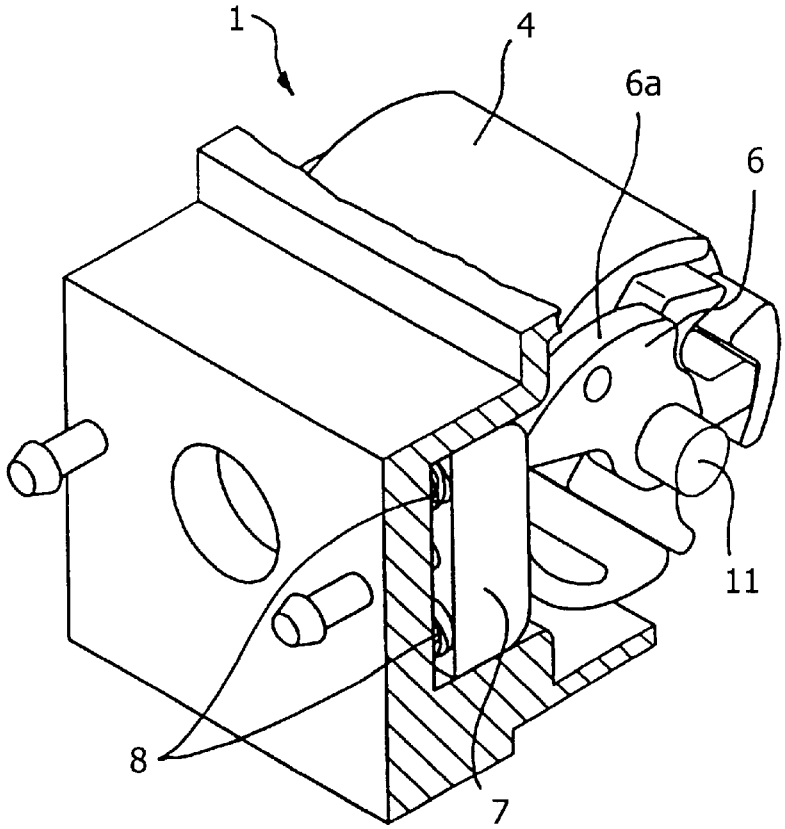
FIG. 2 is a fragmentary, perspective view of the safety switch in actuated state.

Throughout all the Figures, same or corresponding elements are generally indicated by same reference numerals.

Figure 3:
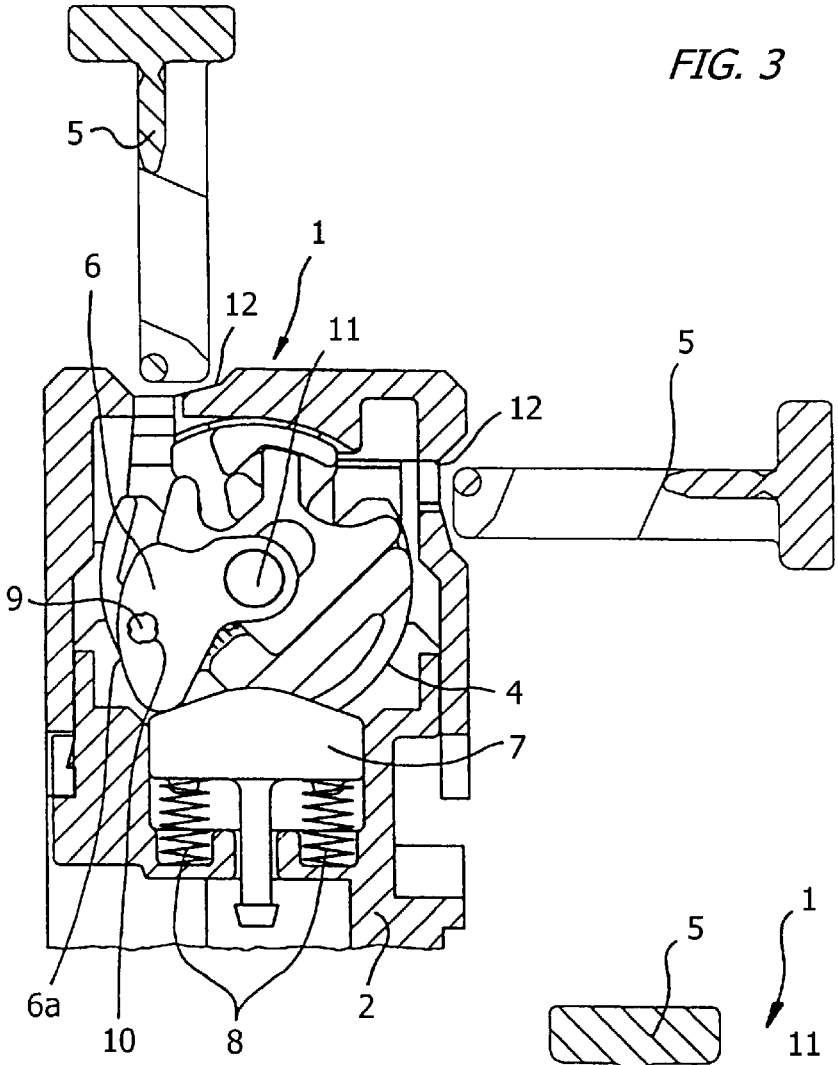
FIG. 3 is a sectional view of the safety switch of FIG. 1.

Turning now to the drawing, and in particular to FIG. 1, there is shown a fragmentary, perspective view of a safety switch according to the present invention, generally designated by reference numeral 1. The safety switch 1 includes a housing 2, which is only partially shown and accommodates a controller drum 4 for operation of a switch plunger 3 (cf. FIGS. 7 and 8) which actuates switch contacts (not shown). The drum 4 can be operated by means of a specially configured operating key or actuator 5 that is part of a switching and locking mechanism and can be inserted in the housing 2 through a lateral access opening 12, as shown, for example, in FIGS. 3 and 4. Suitably, the housing 2 may be is provided with two such access openings 12 for selective insertion by the actuator 5, e.g. an access opening 12 in a lateral surface and access opening 12 in a top surface. Thus, persons skilled in the art will understand that the illustration of two actuators 5 in the drawing is done for illustrative purposed only to show the ability to insert the actuator 5 from different directions. In practice, certainly only one actuator 5 is being used. It will be further appreciated by persons skilled in the art that the basic structure and operation of a safety switch of this type, including the usual electrical switching elements and locking elements, are generally known and thus will not be described herein in more detail for sake of simplicity.

In accordance with the present invention, the safety switch 1 is equipped with an additional safety mechanism by which the position of the actuator 5 with respect to the housing 2 can be controlled. In the embodiment, shown in FIGS. 1 to 4, the safety mechanism is so constructed as to prevent the actuator 5 from inadvertently disengage from the housing 2. This feature is, in particular, of advantage in situations where the safety switch 1 is exposed to vibrations, shocks or the like.

As shown in FIG. 1, the controller drum 4 has attached in fixed rotative engagement on each of its opposite end faces a contact structure 6 in the form of a cam plate. The cam plate 6 has outer edges 6*a* for engagement by a plunger 7 which is slidably supported in a pocket 13 of the housing 2 and loaded by springs 8 in direction of the cam plate 6. Each cam plate 6 is so designed that the plunger 7 is shifted in opposition to the spring force applied by the springs 8 when the controller drum 4 is actuated by the actuator 5. In this actuation position of the controller drum 4, shown in FIGS. 2 and 4, the spring-loaded plunger 7 applies a torque onto the cam plates 6 in a direction which is identical to the direction of rotation of the controller drum 4 into the actuation position. In order to accomplish these interrelationships, the cam plate 6 has a curved section which coincides with the effective rotational angle range of the controller drum 4 and is so configured that, in direction of rotation of the controller drum into the actuation position, the curved section continuously ascends until shortly before reaching the actuation position and descends after surpassing an upper dead center.

Figure 4:
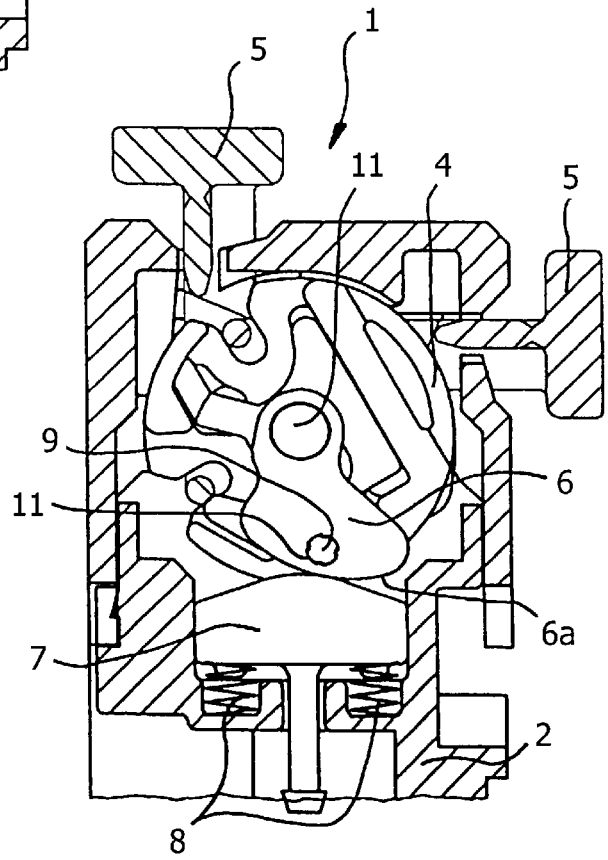
FIG. 4 is a sectional view of the safety switch of FIG. 2.

FIG. 4 shows the actuation position of the controller drum 4, in which the actuator 5 is additionally guarded against inadvertent detachment, and clearly illustrates that the cam plates 6 are spring-loaded by the plunger 7 in a same direction of rotation as the controller drum 4 as a result of the actuator 5 inserted in the access opening 12 of the housing 2. By suitably dimensioning the springs 8, the actuator 5 can be positively guarded against detachment from the housing 2 even when the safety switch 1 is exposed to extreme shocks or, other random external forces acting on the safety switch 1.

Figure 5:
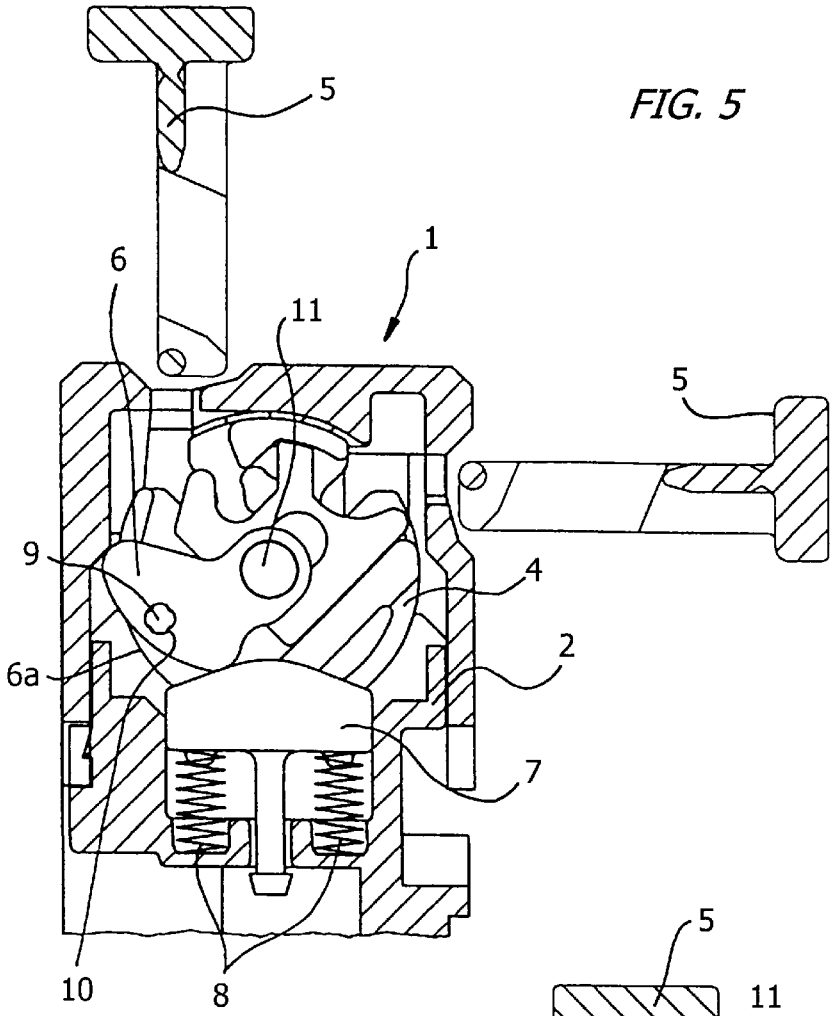
FIG. 5 is a sectional view of another embodiment of a safety switch according to the present invention in idle state.
Figure 6:
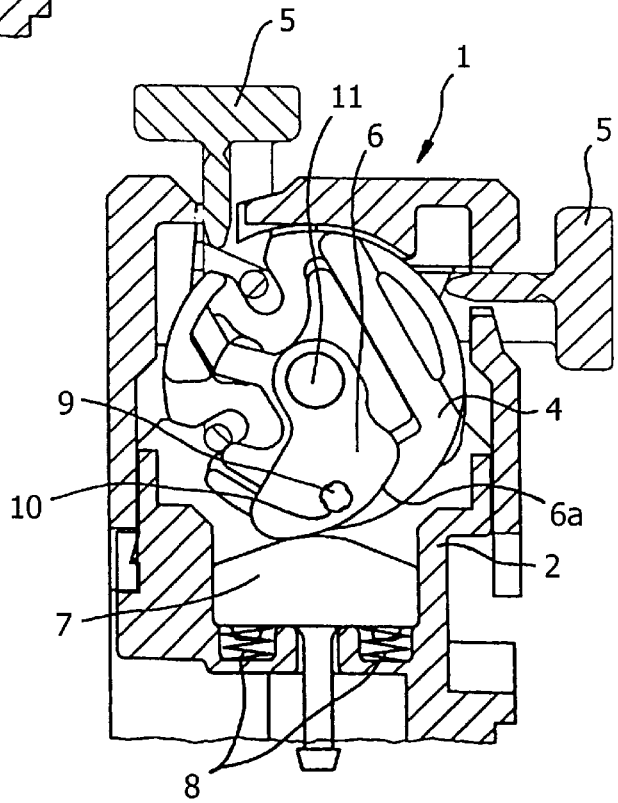
FIG. 6 is a sectional view of the safety switch of FIG. 5 in actuated state.

Turning now to FIGS. 5 and 6, there is shown a safety mechanism which targets a different safety aspect. This safety mechanism is effective in situations in which a "master key", i.e. an actuator 5 which is independent from a protective hood or the like, is manually inserted by an operator into the housing 2 to retain the controller drum 4 in the actuation position for only as long as the operator applies external forces onto the master key. In the embodiment of FIGS. 5 and 6, the cam plates 6 are so designed that the spring-loaded plunger 7 applies, in direction of rotation of the controller drum 4 into actuation position, onto the cam plates 6 and thus onto the controller drum 4 a torque which acts in opposition to the direction of rotation of the controller drum 4 into the actuation position. Thus, as soon as the operator lets go of the master key 5, for example as a result of carelessness or distraction of any kind, the master key 5 is immediately ejected from the housing 2 as the controller drum 4 is rotated by the spring-loaded plunger 7 via the cam plates 6 away from the actuation position, so that the safety switch 1 is switched off.

Although in both embodiments of the safety mechanism according to FIGS. 1 to 4 as well as FIGS. 5 and 6, the cam plates 6 are mounted in fixed rotative engagement to both end faces of the controller drum 4, it will be appreciated that the safety features, as described above, can also be realized by employing only one cam plate 6 which is mounted in fixed rotative engagement to only one of the end faces of the controller drum 4. However, the use of two cam plates 6, respectively mounted to both end faces of the controller drum 4, provides the added benefit of a uniformity of the torque applied onto the controller drum 4.

It will be appreciated by persons skilled in the art that the use of a cam plate 6 as contact structure for interaction with the controller drum 4 is shown by way of example only, as other contact structures, for example eccentric plates, may be equally suitable to realize the described safety features.

In accordance with the present invention, the configuration of the cam plates 6 is so geometrically configured that the safety aspects as described with reference to FIGS. 1 to 4, on the one hand, and FIGS. 5 and 6, on the other hand, can be accomplished by using the same cam plates 6, by simply turning around the cam plates 6 for attachment to the end faces of the controller drum 4.

Figure 7:
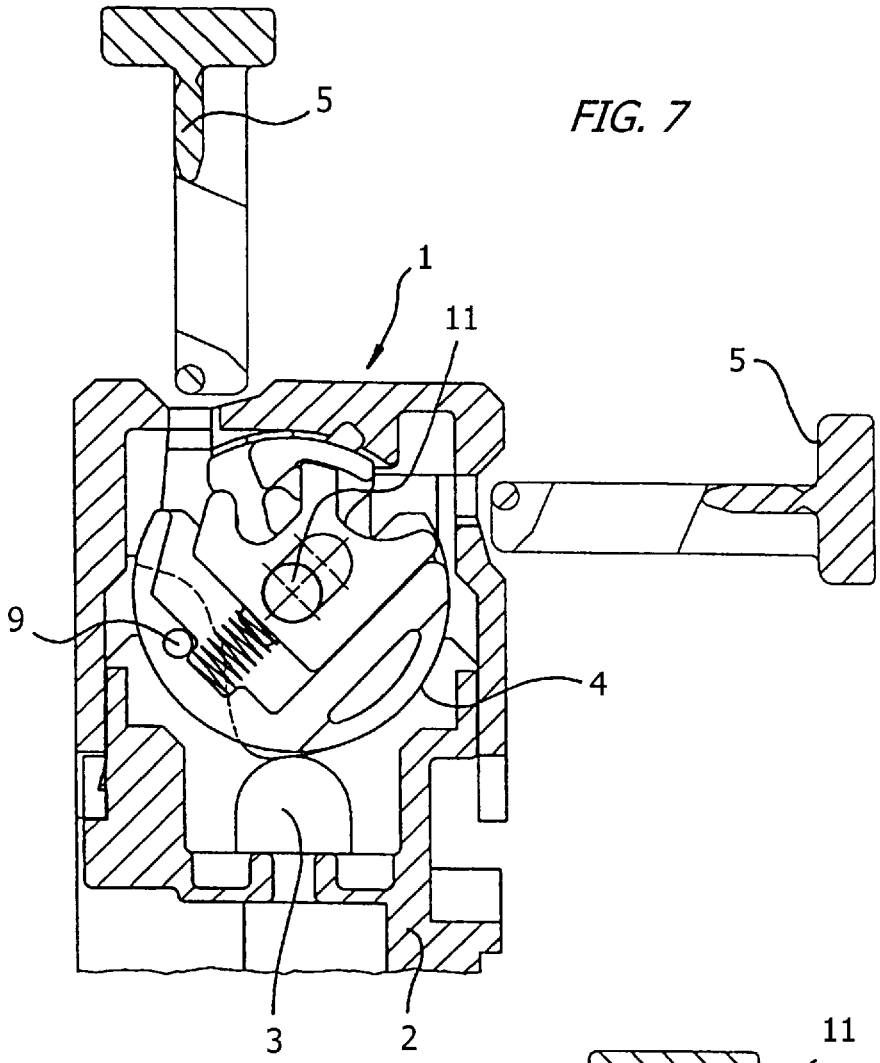
FIG. 7 is a sectional view of the safety switch of FIG. 3, without illustration of a cam plate.
Figure 8:
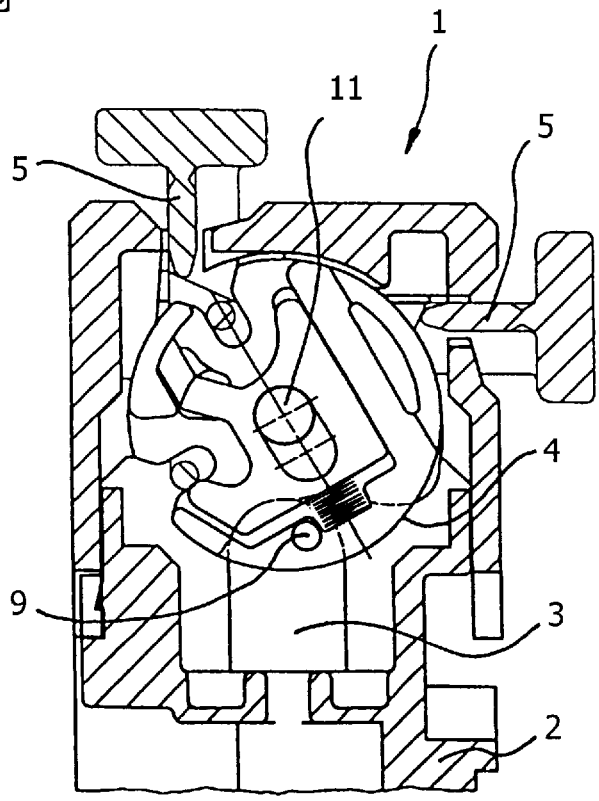
FIG. 8 is a sectional view of the safety switch of FIG. 7 in actuated state.

FIGS. 7 and 8 show in more detail the fixed rotative engagement between the cam plates 6 and the controller drum 4. Projecting out from each end face of the controller drum 4 is a pin 9 which engages in a complementary bore 10 of the associated cam plate 6, with the cam plate 6 being placed over an axle 11 of the controller drum 4. In order to change the safety feature of the safety switch, for example, from the assembly in FIGS. 3 and 4, to the assembly of FIGS. 5 and 6, it is only necessary to turn the cam plates 6 by 180° and then attach them to the axle 11, with the pins 9 of the controller drum 4 engaging the pertaining bores 10 of the cam plates 6.

As further shown in FIGS. 4 to 6, the plunger 7 has a contact area of roof-shaped configuration for engagement on the cam plates 6, to thereby realize a relatively smooth traveling between the cam plates 6 and the plunger 7.

While the invention has been illustrated and described as embodied in a safety switch, it is not intended to be limited to the details shown since various modifications and structural changes may be made without departing in any way from the spirit of the present invention.

What is claimed as new and desired to be protected by letters patent is set forth in the appended claims:

What is claimed is:

1. A safety switch; comprising:

a housing;

a switching mechanism for actuating a switch plunger, said switching mechanism including a controller drum having opposite end faces and rotatably mounted in the housing, and an actuator insertable from outside into the housing for rotation of the controller drum about a predetermined angle into an actuation position of the switch plunger; and a safety mechanism for preventing the actuator from inadvertent detachment, said safety mechanism including at least one contact structure attached in fixed rotative engagement to one of the end faces of the controller drum and having an outer edge, and a plunger bearing on the outer edge of the at least one contact structure, said plunger being loaded by at least one spring and slidably mounted in the housing for movement in opposition to the spring to apply onto the at least one contact structure and thereby onto the controller drum a torque which acts in a same direction as a direction of rotation of the controller drum into the actuation position.

2. The safety switch of claim 1 wherein the contact structure is an element selected from the group consisting of cam plate and eccentric plate.

3. The safety switch of claim 1 wherein the controller drum has an effective range of angle of rotation, said contact structure having a curved section in the effective range of angle of rotation, said curved section being so designed as to have in the direction of rotation of the controller drum a continuously ascending configuration until shortly before reaching the actuation position and a descending configuration after surpassing an upper dead center.

4. The safety switch of claim 1 wherein the controller drum is mounted on a axle for rotation in the housing, said contact structure being placed over the axle of the controller drum and having a bore for engagement of a pin which is securely fixed to the controller drum, to thereby realize the fixed rotative engagement between the contact structure and the controller drum.

5. The safety switch of claim 1 wherein the contact structure is selectively attachable to the controller drum in two 180° rotated positions.

6. The safety switch of claim 1 wherein the plunger has a roof-shaped configuration for engagement on the outer edge of the contact structure.

7. A safety switch; comprising:

a housing;

a switching mechanism for actuating a switch plunger, said switching mechanism including a controller drum having opposite end faces and rotatably mounted in the housing, and an actuator insertable from outside into the housing for rotation of the controller drum about a predetermined angle into an actuation position of the switch plunger; and a safety mechanism for preventing the actuator from inadvertent detachment, said safety mechanism including at least one contact structure attached in fixed rotative engagement to one of the end faces of the controller drum and having an outer edge, and a plunger bearing on the outer edge of the at least one contact structure, said plunger being loaded by at least one spring and slidably mounted in the housing for movement in opposition to the spring to apply onto the at least one contact structure and thereby onto the controller drum a torque which acts in an opposite direction to a direction of rotation of the controller drum into the actuation position.

8. The safety switch of claim 7 wherein the contact structure is an element selected from the group consisting of cam plate and eccentric plate.

9. The safety switch of claim 7 wherein the controller drum has an effective range of angle of rotation, said contact structure having a curved section in the effective range of angle of rotation, said curved section being so designed as to have in the direction of rotation of the controller drum a continuously ascending configuration until the actuation position of the controller drum is reached.

10. The safety switch of claim 7 wherein the controller drum is mounted on a axle for rotation in the housing, said contact structure being placed over the axle of the controller drum and having a bore for engagement of a pin which is securely fixed to the controller drum, to thereby realize the fixed rotative engagement between the contact structure and the controller drum.

11. The safety switch of claim 7 wherein the contact structure is selectively attachable to the controller drum in two 180° rotated positions.

12. The safety switch of claim 7 wherein the plunger has a roof-shaped configuration for engagement on the outer edge of the contact structure.

13. A safety switch; comprising:

a housing;

a switching mechanism for actuating a switch plunger, said switching mechanism including a controller drum having opposite end faces and rotatably mounted in the housing, and an actuator insertable from outside into the housing for rotation of the controller drum about a predetermined angle into an actuation position of the switch plunger; and a safety mechanism for controlling the position of the actuator with respect to the housing, said safety mechanism including at least one contact structure attached in fixed rotative engagement to one of the end faces of the controller drum, and a plunger bearing on the at least one contact structure, said plunger being loaded by at least one spring and slidably mounted in the housing for movement in opposition to the spring to apply a torque onto the at least one contact structure and thereby onto the controller drum.

14. The safety switch of claim 13 wherein the contact structure is an element selected from the group consisting of cam plate and eccentric plate.

15. The safety switch of claim 13 wherein the contact structure has a curved section for engagement by the plunger, said curved section being so designed that the torque applied onto the controller drum acts in a same direction as the direction of rotation of the controller drum into the actuation position, to thereby prevent an inadvertent detachment of the actuator from the housing.

16. The safety switch of claim 15 wherein the curved section of the contact structure has, in the direction of rotation of the controller drum, a continuously ascending configuration until shortly before reaching the actuation position and a descending configuration after surpassing an upper dead center.

17. The safety switch of claim 13 wherein the contact structure has a curved section for engagement by the plunger, said curved section being so designed that the torque applied onto the controller drum acts in an opposite direction to the direction of rotation of the controller drum into the actuation position, to thereby realize an ejection of the actuator from the housing when an outside force on the actuator is removed.

18. The safety switch of claim 17 wherein the curved section of the contact structure has, in the direction of rotation of the controller drum, a continuously ascending configuration until the actuation position of the controller drum is reached.

19. The safety switch of claim 13 wherein the controller drum is mounted on a axle for rotation in the housing, said contact structure being placed over the axle of the controller drum and having a bore for engagement of a pin which is securely fixed to the controller drum, to thereby realize the fixed rotative engagement between the contact structure and the controller drum.

20. The safety switch of claim 13 wherein the contact structure is selectively attachable to the controller drum in two 180° rotated positions.

21. The safety switch of claim 13 wherein the plunger has a roof-shaped configuration for engagement on the contact structure.

* * * * *